US011670834B2

(12) United States Patent
Kim

(10) Patent No.: US 11,670,834 B2
(45) **Date of Patent: *Jun. 6, 2023**

(54) ANTENNA APPARATUS AND VEHICLE INCLUDING THE SAME

(71) Applicants: HYUNDAI MOTOR COMPANY, Seoul (KR); KIA MOTORS CORPORATION, Seoul (KR)

(72) Inventor: Dongjin Kim, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 259 days.

This patent is subject to a terminal disclaimer.

(21) Appl. No.: 17/110,515

(22) Filed: Dec. 3, 2020

(65) Prior Publication Data

US 2021/0336329 A1 Oct. 28, 2021

(30) Foreign Application Priority Data

Apr. 27, 2020 (KR) ..... 10-2020-0050615

(51) Int. Cl.

| | |
|---|---|
| ***H01Q 1/32*** | (2006.01) |
| ***H01Q 1/38*** | (2006.01) |
| ***H01Q 21/06*** | (2006.01) |
| ***H01Q 21/24*** | (2006.01) |
| ***H01Q 13/10*** | (2006.01) |

(52) U.S. Cl.
CPC ..... *H01Q 1/38* (2013.01); *H01Q 13/10* (2013.01); *H01Q 21/064* (2013.01); *H01Q 21/24* (2013.01)

(58) Field of Classification Search
CPC ..... H01Q 1/38; H01Q 13/10; H01Q 21/064; H01Q 21/24; H01Q 13/106; H01Q 21/08; H01Q 1/1271; H01Q 1/3291; H01Q 1/50; H01Q 1/325; H01Q 1/46; H01Q 3/30
See application file for complete search history.

(56) References Cited

U.S. PATENT DOCUMENTS

| | | | | |
|---|---|---|---|---|
| 10,020,567 | B2 * | 7/2018 | Kim | H01Q 3/24 |
| 2005/0162327 | A1 * | 7/2005 | Mori | H01Q 9/0442 343/770 |
| 2005/0162328 | A1 * | 7/2005 | Mori | H01Q 3/44 343/770 |

* cited by examiner

*Primary Examiner* — David E Lotter
(74) *Attorney, Agent, or Firm* — McDonnell Boehnen Hulbert & Berghoff LLP

(57) ABSTRACT

Disclosed is an antenna apparatus including a conductive plate on which a main slot, a sub slot, and a slot coupler are formed, a feed line, and a dielectric provided between the conductive plate and the feed line. The main slot, the sub slot, and the slot coupler are formed to penetrate the conductive plate. The slot coupler extends from the sub slot to the vicinity of the main slot. Thereby, the antenna apparatus is able to communicate smoothly with a preceding vehicle and/or a following vehicle.

16 Claims, 17 Drawing Sheets

ANTENNA APPARATUS AND VEHICLE INCLUDING THE SAME

CROSS REFERENCE TO RELATED APPLICATIONS

This application is based on and claims priority under 35 U.S.C. § 119 to Korean Patent Application No. 10-2020-0050615, filed on Apr. 27, 2020, in the Korean Intellectual Property Office, the disclosure of which is incorporated by reference herein in its entirety.

BACKGROUND

1. Field

The disclosure relates to an antenna apparatus and a vehicle including the same, and more particularly, to an antenna apparatus installed on a front window or a rear window, and a vehicle including the same.

2. Description of the Related Art

In general, a vehicle refers to a means of transportation that travels on a road or track using fossil fuel, electricity, or the like as a power source.

In recent years, more than just transporting goods and personnel, vehicles generally include audio and video devices so that a driver may listen to music and watch videos while driving, and are also widely equipped with a navigation device that displays a route to a location where a driver is desired.

In recent years, the need for a vehicle to communicate with an external device (or an external vehicle) is increasing. For example, the need for vehicle-to-vehicle (V2V) communication with a preceding vehicle and/or a following vehicle is increasing.

For smooth inter-vehicle communication with a preceding vehicle and/or a following vehicle, it is preferable that an antenna for transmitting and receiving a radio signal is disposed at the front and/or rear of a vehicle.

SUMMARY

It is an aspect of the disclosure to provide an antenna apparatus disposed on a front window and/or a rear window.

It is another aspect of the disclosure to provide an antenna apparatus capable of beam-forming from an inclined front window and/or an inclined rear window toward the front and/or rear of a vehicle.

Additional aspects of the disclosure will be set forth in part in the description which follows and, in part, will be obvious from the description, or may be learned by practice of the disclosure.

In accordance with an aspect of the disclosure, an antenna apparatus includes a conductive plate on which a main slot, a sub slot, and a slot coupler are formed, a feed line, and a dielectric positioned between the conductive plate and the feed line. The main slot, the sub slot, and the slot coupler may be formed to penetrate the conductive plate. The slot coupler may extend from the sub slot to a position adjacent to the main slot.

The main slot may be formed such that a width in a long axis direction is longer than a width in a short axis direction. The sub slot may be disposed to be spaced apart from the main slot in the long axis direction of the main slot.

The slot coupler may include a coupling induction portion extending parallel to the main slot in the vicinity of the main slot, a slot connection portion connected to the sub slot, and a phase delay portion disposed between the coupling induction portion and the slot connection portion.

The phase delay portion may be formed in an S-shape and may extend from the coupling induction portion to the slot connection portion.

The slot coupler may be configured to couple the sub slot to the main slot.

The antenna apparatus may further include a coupler switch disposed across the slot coupler to allow or block coupling between the sub slot and the main slot.

A radiation pattern of the antenna apparatus may be changed depending on turn-on or turn-off of the coupler switch.

In accordance with an aspect of the disclosure, an antenna apparatus includes a conductive plate on which a main slot, a first sub slot, a second sub slot, a first slot coupler, and a second slot coupler are formed, a feed line, and a dielectric provided between the conductive plate and the feed line. The main slot, the first sub slot, the second sub slot, the first slot coupler, and the second slot coupler may be formed to penetrate the conductive plate. The first slot coupler may extend from the first sub slot to near the main slot. The second slot coupler may extend from the second sub slot to a position adjacent to the main slot.

The main slot may be formed such that a width in a long axis direction is longer than a width in a short axis direction. The first sub slot may be disposed to be spaced apart from the main slot in the long axis direction of the main slot. The second sub slot may be disposed to be spaced apart from the main slot on the opposite side of the first sub slot in the long axis direction of the main slot.

The first and second slot couplers may include first and second coupling induction portions extending parallel to the main slot in the vicinity of the main slot, first and second slot connection portions connected to the first and second sub slots, and first and second phase delay portions disposed between the first and second coupling induction portions and the first and second slot connection portions, respectively.

The first and second phase delay portions may be formed in an S shape and extend from the first and second coupling induction portions to the first and second slot connection portions, respectively.

The first and second slot couplers may be configured to couple the first and second sub slots to the main slot, respectively.

The antenna apparatus may further include a first coupler switch disposed across the first slot coupler to allow or block coupling between the first sub slot and the main slot, and a second coupler switch disposed across the second slot coupler to allow or block coupling between the second sub slot and the main slot.

A radiation pattern of the antenna apparatus may be changed depending on turn-on or turn-off of each of the first and second coupler switches.

In accordance with an aspect of the disclosure, a vehicle includes a front window, a wireless communication device, and an antenna apparatus provided on the front window to be electrically connect to the wireless communication device. The antenna apparatus may include a conductive plate on which a main slot, a sub slot, and a slot coupler are formed, a feed line, and a dielectric provided between the conductive plate and the feed line. The main slot, the sub slot, and the slot coupler may be formed to penetrate the conductive plate. The slot coupler may extend from the sub slot to a position adjacent to the main slot to couple the sub slot to the main slot. The antenna apparatus may further include a coupler switch disposed across the slot coupler to allow or block coupling between the sub slot and the main slot in response to a control signal of the wireless communication device.

A radiation pattern of the antenna apparatus may be changed depending on turn-on or turn-off of the coupler switch.

The main slot may be formed such that a width in a long axis direction is longer than a width in a short axis direction. The sub slot may be disposed to be spaced apart from the main slot in the long axis direction of the main slot.

The slot coupler may include a coupling induction portion extending parallel to the main slot in the vicinity of the main slot, a slot connection portion connected to the sub slot, and a phase delay portion disposed between the coupling induction portion and the slot connection portion.

The phase delay portion may be formed in an S-shape and may extend from the coupling induction portion to the slot connection portion.

BRIEF DESCRIPTION OF THE FIGURES

These and/or other aspects of the disclosure will become apparent and more readily appreciated from the following description of the embodiments, taken in conjunction with the accompanying drawings of which.

DETAILED DESCRIPTION

Hereinafter, an operation principle and embodiments of the disclosure will be described with reference to the accompanying drawings.

Figure 1:
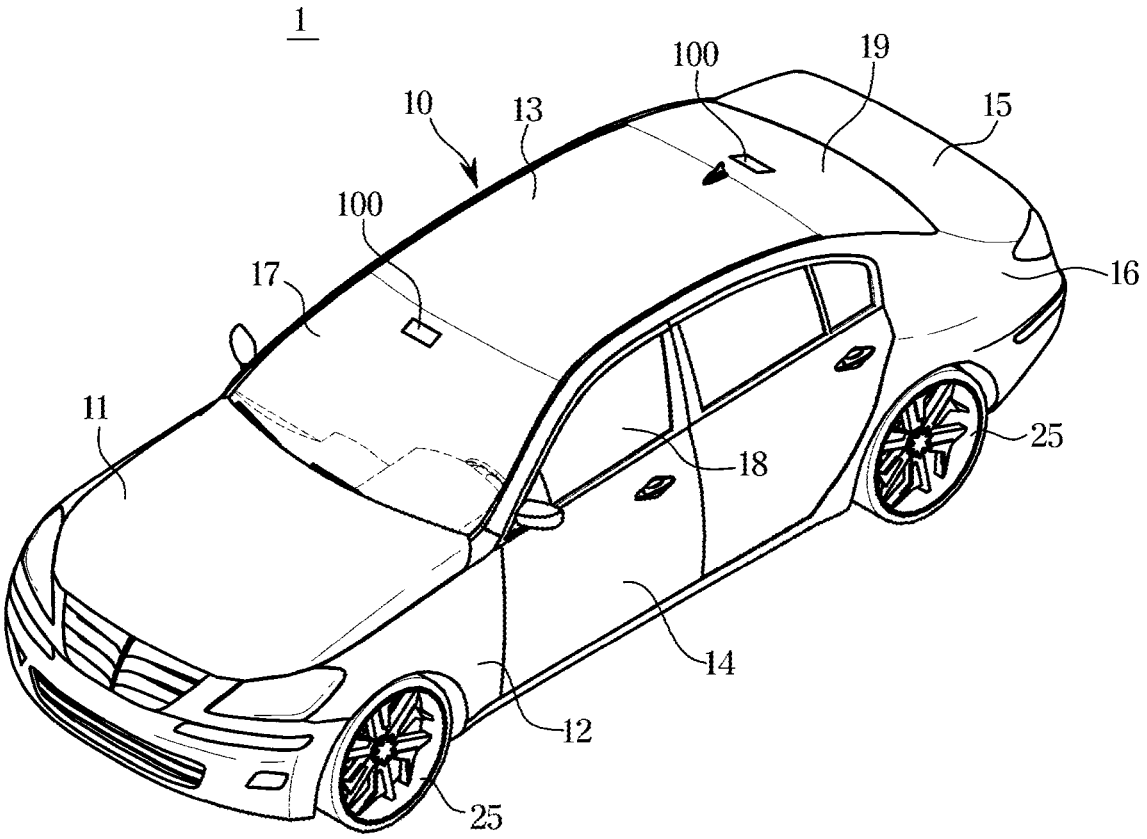
FIG. 1 illustrates a vehicle according to an embodiment.
Figure 2:
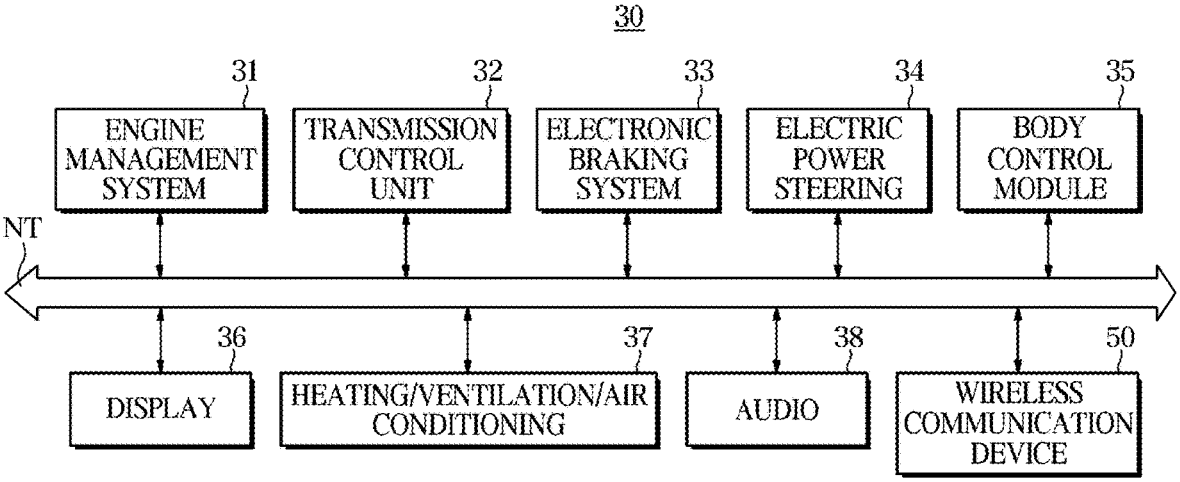
FIG. 2 illustrates electronic components of the vehicle according to an embodiment.

FIG. 1 illustrates a vehicle according to an embodiment, and FIG. 2 illustrates electronic components of the vehicle according to an embodiment.

A vehicle 1 may include a body 10 forming an outer appearance of the vehicle 1 and accommodating a driver and/or luggage, a chassis including configuration components of the vehicle 1 other than the body, and electronic components to protect the driver and provide convenience to the driver.

Referring to FIGS. 1 and 2, the vehicle 1 may include a hood 11, front fenders 12, a roof panel 13, doors 14, a trunk lid 15, quarter panels 16, and the like. In order to secure a driver's view, a front window 17 is provided on the front of the body 10, side windows 18 are provided on sides of the body 10, and rear windows 19 are provided on the rear of the body 10. The front window 17 and the rear window 19 each are provided with an antenna apparatus 100 capable of communicating with a preceding vehicle and a following vehicle, respectively.

The vehicle 1 may also include an engine management system (EMS) 31, a transmission control unit (TCU) 32, an electronic braking system (EBS) 33, an electric power steering (EPS) 34, a body control module (BCM) 35, a display 36, a heating/ventilation/air conditioning (HVAC) 37, an audio 38, a wireless communication device 50, and the like.

The wireless communication device 50 may wirelessly communicate with another vehicle, a user terminal, or a communication repeater. The wireless communication device 50 may be used for vehicle to vehicle communication (V2V communication), vehicle to infrastructure communication (V2I communication), vehicle to nomadic devices communication (V2N communication), vehicle to grid communication (V2G communication), and the like.

The wireless communication device 50 may send and receive signals through various communication methods. The wireless communication device 50 may use a short-range wireless communication method, such as, for example, dedicated short range communication (DSRC) and wireless access in vehicular environments (WAVE). Also, the wireless communication device 50 may use a mobile communication method such as, for example, time division multiple access (TDMA) and code division multiple access (CDMA).

The wireless communication device 50 may be connected to the antenna apparatus 100 for sending and receiving wireless signals to and from another vehicle, a user terminal, or a communication repeater. The antenna apparatus 100 may be installed on the front window 17 and/or the rear window 19 of the vehicle 1 as illustrated in FIG. 1.

In addition, the vehicle 1 may further include electronic components to protect a driver and provide convenience to the driver. For example, the vehicle 1 may include electronic components 30 such as door locks, wipers, power seats, seat heaters, clusters, room lamps, a navigation system, and multi-function switches.

The electronic components 30 may communicate with each other through a vehicle communication network NT. For example, the electronic components 30 may exchange data with each other through Ethernet, a media oriented systems transport (MOST), Flexray, a controller area network (CAN), a local interconnect network (LIN), etc.

Figure 3A:
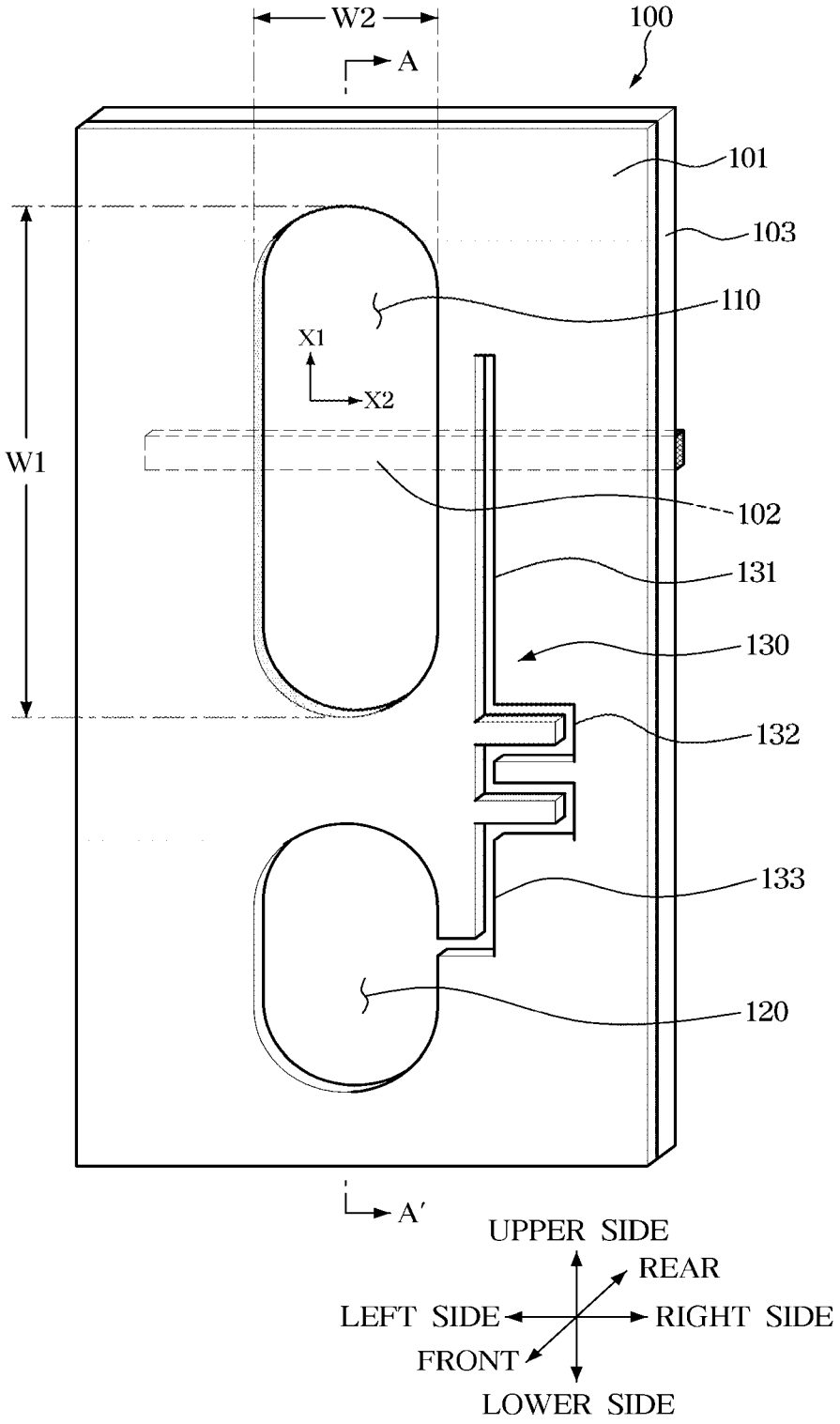
FIGS. 3A and 3B illustrate an antenna apparatus according to an embodiment.
Figure 3B:
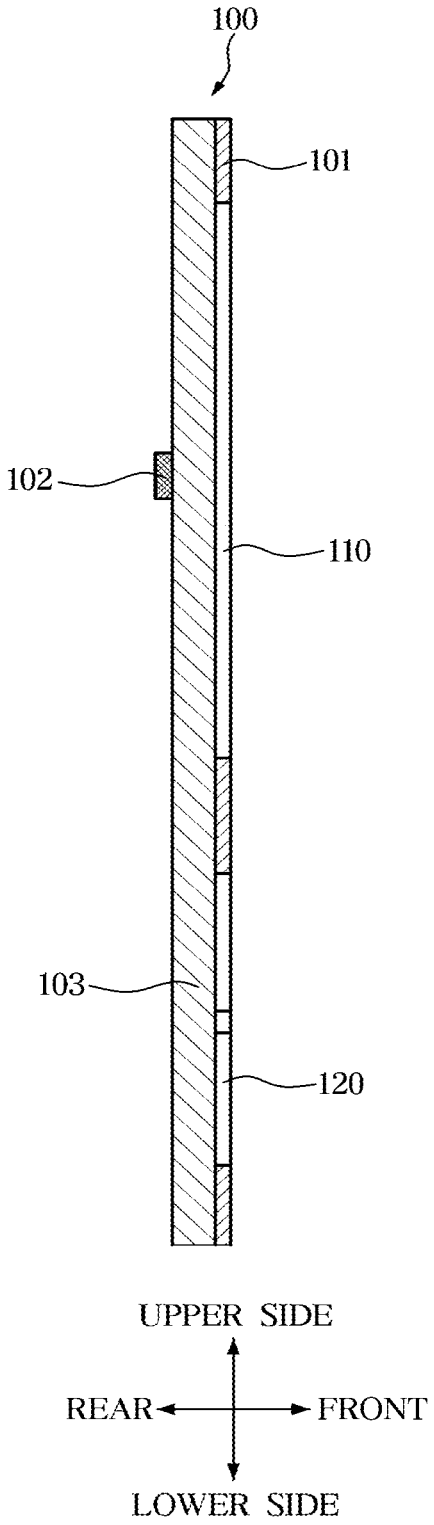
Figure 4:
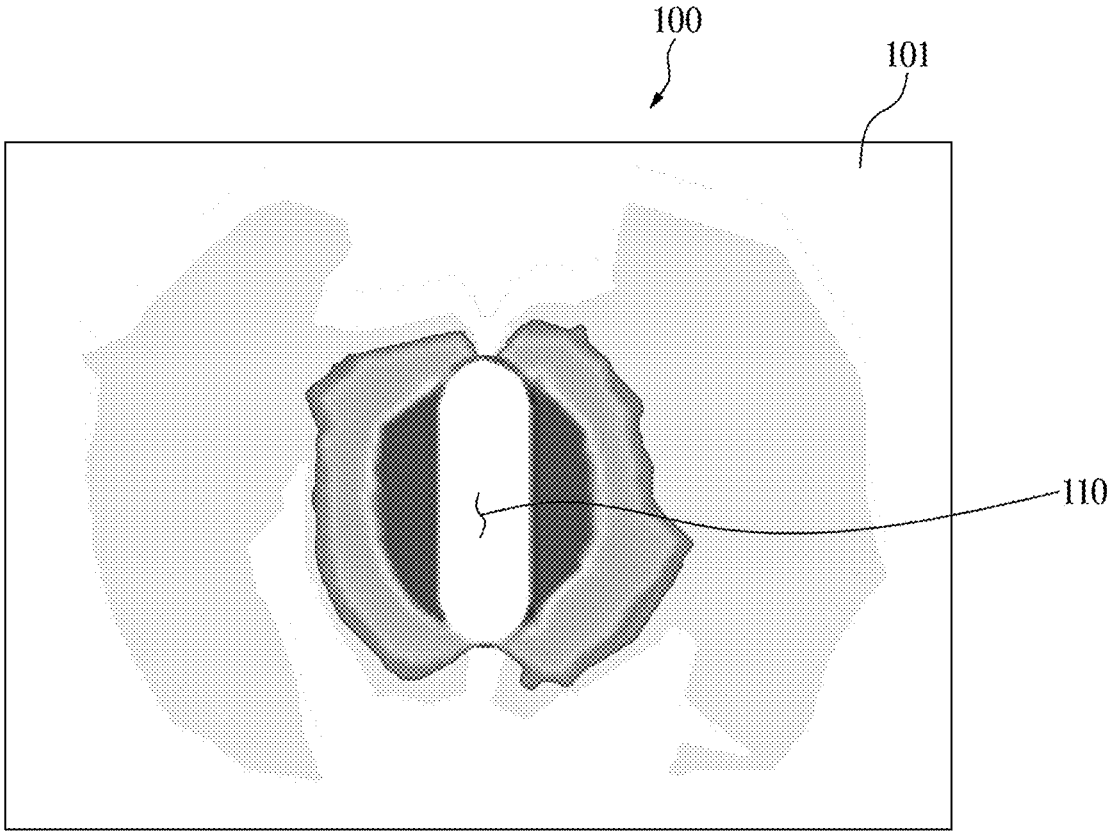
FIG. 4 illustrates a current distribution in a slot antenna including a main slot.
Figure 5:
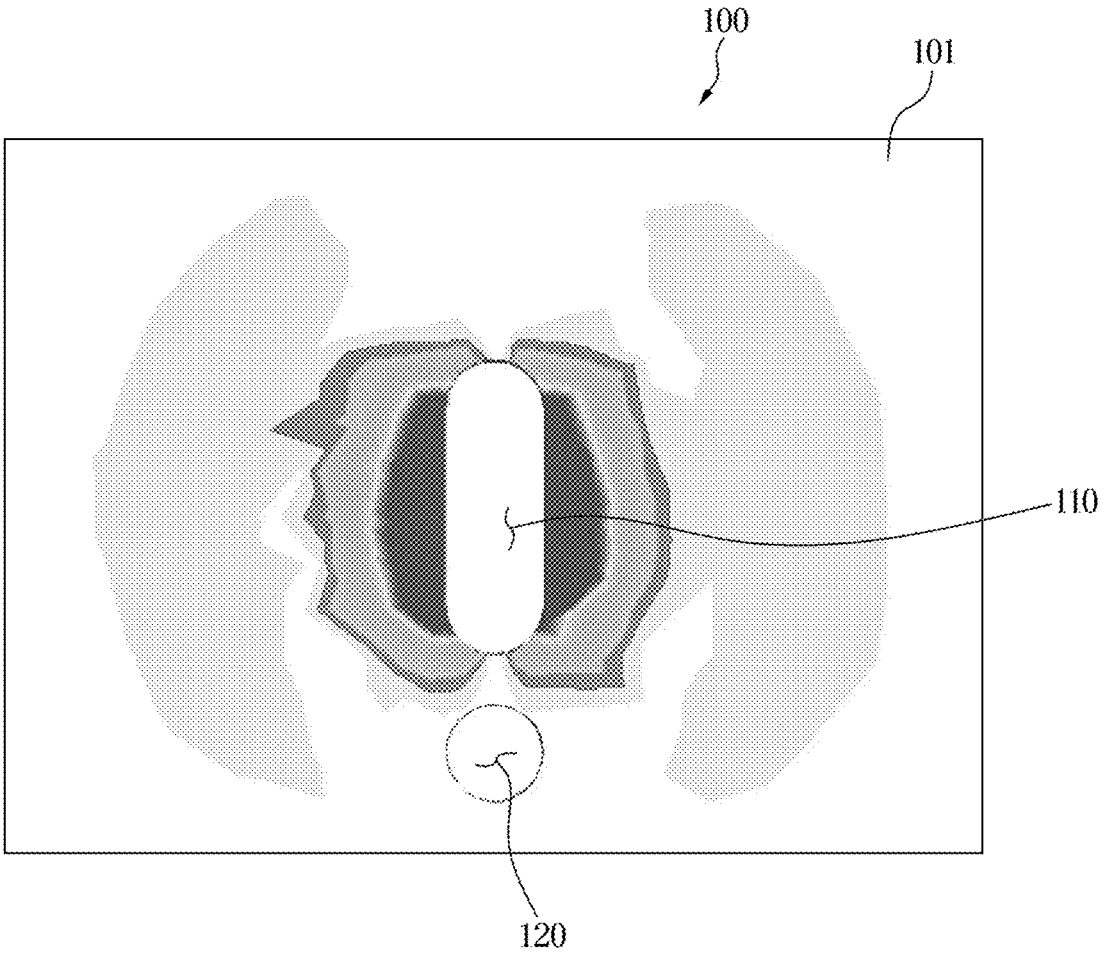
FIG. 5 illustrates a current distribution in a slot antenna including a main slot and a sub slot.
Figure 6:
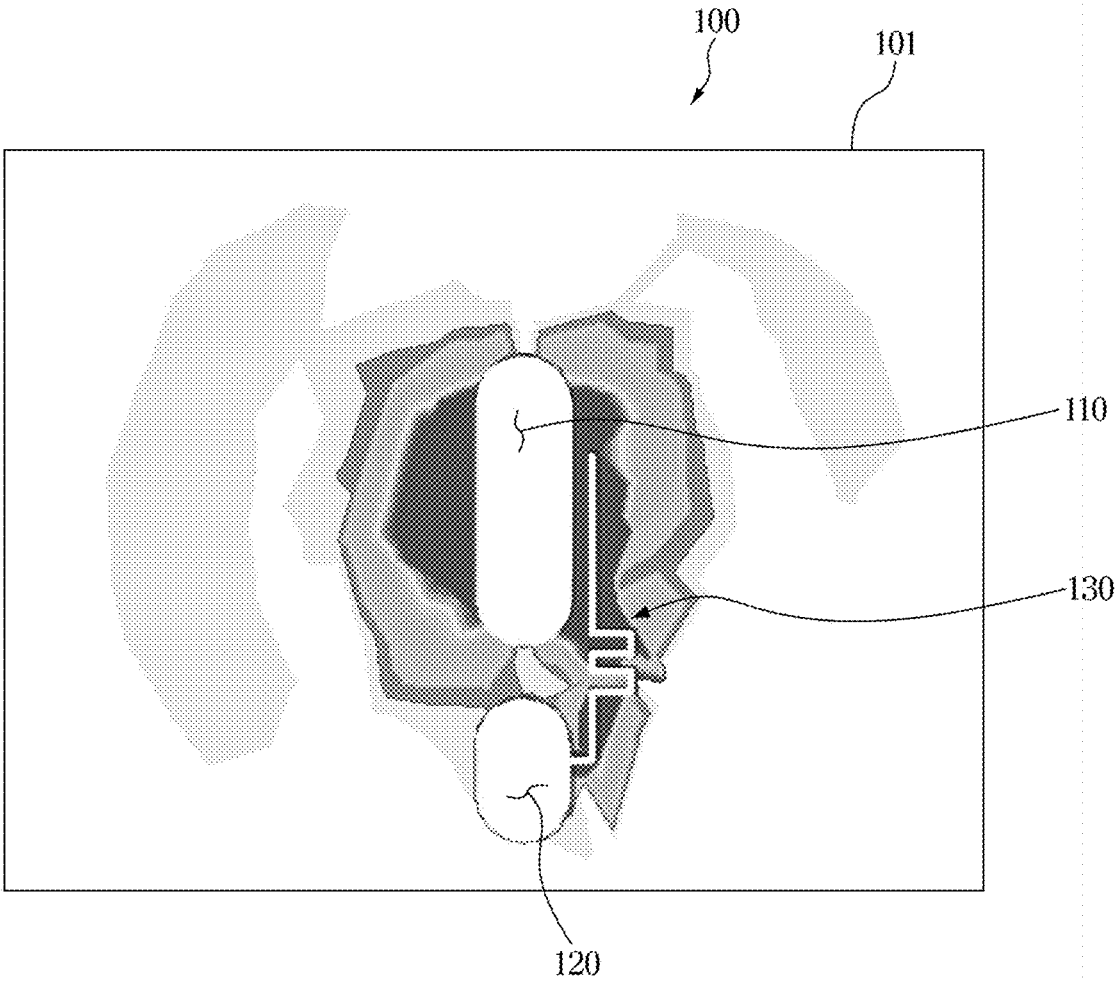
FIG. 6 illustrates a current distribution in the antenna apparatus according to an embodiment.
Figure 7:
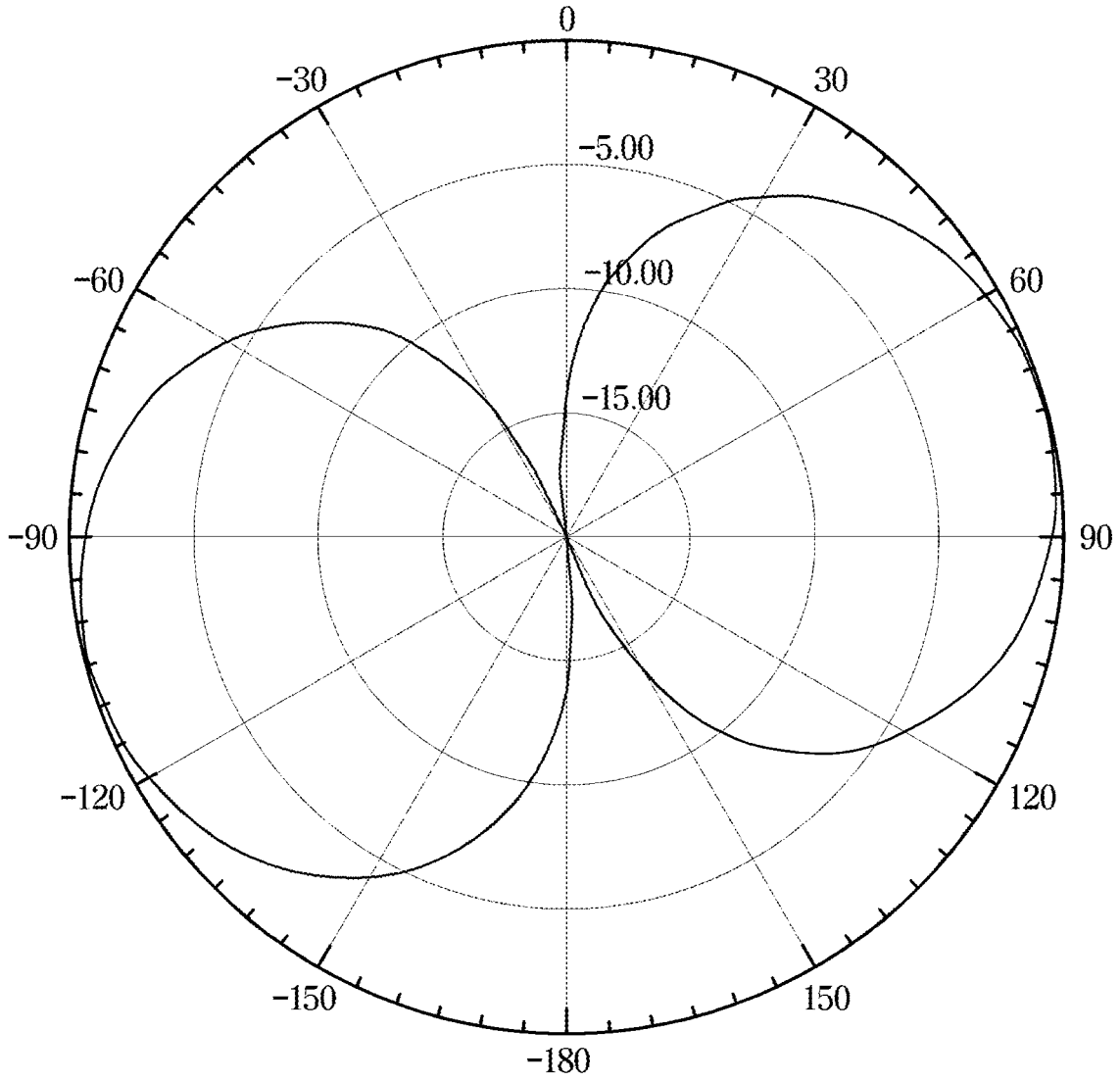
FIG. 7 illustrates a radiation pattern in the antenna apparatus according to an embodiment.
Figure 7:
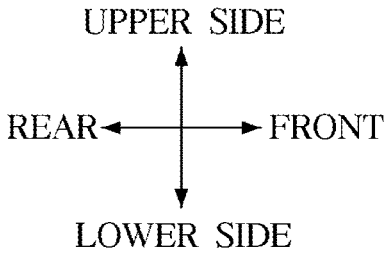

FIGS. 3A-3B illustrate an antenna apparatus according to an embodiment, FIG. 4 illustrates a current distribution in a slot antenna including a main slot, FIG. 5 illustrates a current distribution in a slot antenna including a main slot and a sub slot, FIG. 6 illustrates a current distribution in the antenna apparatus according to an embodiment, and FIG. 7 illustrates a radiation pattern in the antenna apparatus according to an embodiment.

FIG. 3A illustrates an outer appearance of the antenna apparatus 100, and FIG. 3B illustrates a cross section taken along line A-A' in FIG. 3A.

The antenna apparatus 100 may be a slot antenna. The slot antenna generally includes an elongated hole or a flat plate having a slot. A length of the slot may depend on the frequency or wavelength of a radiated signal, and a width of the slot may depend on a bandwidth of the radiated signal. The slot antenna is widely used in a frequency band of 300 MHz to 25 GHz, and a radiation pattern of the slot antenna is substantially similar to that of a dipole antenna.

As illustrated in FIGS. 3A-3B, the antenna apparatus 100 includes a conductive plate 101 on which a main slot 110, a sub slot 120, and a slot coupler 130 are formed.

The conductive plate 101 may be made of a conductive material such as a metal through which electricity may flow. For example, the conductive plate 101 may be made of a thin metal thin film so that the antenna apparatus 100 may be bent.

Also, the conductive plate 101 may be made of a transparent material so as not to block a driver's view. For example, the conductive plate 101 may include indium tin oxide (ITO), or may include carbon nanotubes or graphene.

The main slot 110, the sub slot 120, and the slot coupler 130 may be formed to penetrate the conductive plate 101, Radio waves are blocked by the conductive plate 101 made of a conductive material, but may pass through the main slot 110 and the sub slot 120, and the slot coupler 130.

The main slot 110 has a slim and long shape. As illustrated in FIG. 3A, the main slot 110 is formed such that a width W1 in a direction of a long axis X1 is greater than a width 11'2 in a direction of a short axis X2. The width W1 in the direction of the long axis X1 may depend on a wavelength or frequency of a radio signal transmitted and received by the antenna apparatus 100. The width W2 in the direction of the short axis X2 may depend on a bandwidth of the radio signal transmitted and received by the antenna apparatus 100.

The sub slot 120 is formed near the main slot 110. The sub slot 120 may be located on an extension line of the long axis X1 of the main slot 110. In other words, the sub slot 120 may be disposed in the long axis direction.

The sub slot 120 is disposed to be spaced apart from the main slot 110. A distance between the sub slot 120 and the main slot 110 may depend on a radiation direction in which the antenna apparatus 100 emits radio waves.

The sub slot 120 may be smaller than the main slot 110. In other words, an area of the sub slot 120 may be smaller than an area of the main slot 110. A size of the sub slot 120 (a width of the sub slot in the long axis direction of the main slot and a width of the sub slot in the short axis direction of the main slot) may depend on the radiation direction in which the antenna apparatus 100 emits radio waves.

The sub slot 120 may have various shapes. The shape of the sub slot 120 may be, for example, a substantially circular or substantially elliptical, or a square with rounded corners, or a rectangular with rounded corners.

The slot coupler 130 may be disposed near the main slot 110 and the sub slot 120.

The slot coupler 130 includes a coupling induction portion 131 for inducing coupling with the main slot 110, a phase delay portion 132 for phase delaying between the main slot 110 and the sub slot 120, and a slot connection portion 133 connected to the sub slot 120.

As illustrated in FIG. 3A, the slot coupler 130 is connected to the sub slot 120. In other words, the slot coupler 130 may be a slot or a hole integrated with the sub slot 120. The slot coupler 130 and the sub slot 120 may be defined by one closed curve.

A portion of the slot coupler 130 connected to the sub slot 120 may be defined as the slot connection portion 133.

Unlike the slot coupler 130 connected to the sub slot 120, the slot coupler 130 is not connected to the main slot 110. In other words, the slot coupler 130 may be a slot or a hole that is not integrated with the main slot 110. The slot coupler 130 and the main slot 110 are not defined by one closed curve, and may be defined by at least two separate closed curves that do not overlap.

However, the slot coupler 130 may be disposed closer to the main slot 110 than the sub slot 120 for coupling with the main slot 110. In other words, the shortest distance between the slot coupler 130 and the main slot 110 may be shorter than the shortest distance between the sub slot 120 and the main slot 110.

A portion of the slot coupler 130 that is coupled to the main slot 110 may be defined as the coupling induction portion 131. The coupling induction portion 131 may extend along the direction of the long axis X1 of the main slot 110 in the vicinity of the main slot 110. For example, the coupling induction portion 131 may extend parallel to the main slot 110 from one end of the main slot 110 closest to the sub slot 120 toward the other end of the main slot 110. A length in which the coupling induction portion 131 extends from one end of the main slot 110 toward the other end of the main slot 110 may depend on the radiation direction in which the antenna apparatus 100 emits radio waves.

The phase delay portion 132 is positioned between the slot connection portion 133 and the coupling induction portion 131. The phase delay portion 132 may adjust a phase delay between the main slot 110 and the sub slot 120.

For example, the width of the long axis X1 of the main slot 110 substantially corresponds to half the wavelength of a radio signal. In a case where a phase delay of 180 degrees between the main slot 110 and the sub slot 120 is required, the main slot 110 needs to be spaced apart from the sub slot 120 by the widths of the long axis X1 of the main slot 110. When the distance between the main slot 110 and the sub slot 120 increases, the antenna apparatus 100 may be enlarged and the efficiency of the antenna apparatus 100 may be reduced.

The phase delay portion 132 may increase a distance that an electromagnetic field coupled from the main slot 110 by the coupling induction portion 131 travels to the sub slot 120. Thereby, a phase delay between the main slot 110 and the sub slot 120 may be caused.

For example, the phase delay portion 132 may be formed in an S-shape or a zigzag pattern as illustrated in FIG. 3A, The phase delay portion 132 of an S-shape or a zigzag pattern may increase the distance that a signal propagates between the main slot 110 and the sub slot 120 and at the same time may maintain a physical distance between the main slot 110 and the sub slot 120 to a minimum. Thereby, the phase delay between the main slot 110 and the sub slot 120 is sufficiently secured, and the distance between the main slot 110 and the sub slot 120 may be minimized.

The antenna apparatus 100 may further include a feed line 102 and a dielectric 103.

The dielectric 103 is disposed between the feed line 102 and the conductive plate 101. The dielectric 103 may support the feed line 102 and the conductive plate 101 and electrically isolate the feed line 102 and the conductive plate 101.

The dielectric 103 may be composed of a non-conductor through which electricity does not flow, and may include, for example, FR-4 widely used in a printed circuit board. The dielectric 103 may be made of a flexible material so that the antenna apparatus 100 may be bent. For example, the dielectric 103 may include a polyimide film or a polyester film.

The feed line 102 may be provided to be spaced apart from the conductive plate 101 with the dielectric 103 interposed therebetween. For example, the feed line 102 is not in contact with the conductive plate 101 and may be disposed substantially parallel to the conductive plate 101.

The feed line 102 may be provided to extend in the direction of the short axis X2 of the main slot 110. At least a portion of the feed line 102 may overlap the main slot 110. In other words, as illustrated in FIG. 3, the main slot 110 and the feed line 102 may cross at an angle of 90 degrees.

The feed line 102 is electrically connected to the wireless communication device 50 of the vehicle 1. An electrical signal may be provided to the feed line 102 from the wireless communication device 50.

When an electrical signal is input through the feed line 102, an electromagnetic field may be formed around the feed line 102. The electromagnetic field formed around the feed line 102 may resonate by the main slot 110. The electromagnetic field resonating in the main slot 110 may be radiated into a free space.

A current may be induced around the main slot 110 by the electromagnetic field resonating in the main slot 110. The electromagnetic field resonating in the main slot 110 may induce a current around the coupling induction portion 131 of the slot coupler 130 as well as around the main slot 110.

An electromagnetic field may be generated inside the coupling induction portion 131 by a current induced around the coupling induction portion 131. The electromagnetic field generated inside the coupling induction portion 131 may propagate to the slot connection portion 133 along the phase delay portion 132. While the electromagnetic field propagates along the phase delay portion 132, the phase may be delayed.

The electromagnetic field propagated up to the slot connection portion 133 may be transmitted to the sub slot 120. The electromagnetic field transmitted to the sub slot 120 may be radiated from the sub slot 120 to the free space. In other words, a part of the electromagnetic fields resonating in the main slot 110 may be radiated into the free space through the sub slot 120.

While the electromagnetic field propagates from the main slot 110 to the sub slot 120 through the slot coupler 130, a current may be induced around the slot coupler 130 by the electromagnetic field.

As such, the slot coupler 130 may guide the electromagnetic field in the main slot 110 to the sub slot 120. In a case where the slot coupler 130 does not exist, the sub slot 120 may not be coupled to the main slot 110.

For example, a current distribution in an antenna in which only the main slot 110 is formed is as illustrated in FIG. 4. As shown in FIG. 4, the current distribution in the antenna is concentrated around the main slot 110. Accordingly, it is confirmed that radio waves are radiated from the main slot 110 to the free space.

A current distribution in an antenna in which only the main slot 110 and the sub slot 120 are formed is as illustrated in FIG. 5. As shown in FIG. 5, the current distribution in the antenna is concentrated around the main slot 110. Although the sub slot 120 exists around the main slot 110, the current is concentrated around the main slot 110, and no current is distributed in the vicinity of the sub slot 120. Accordingly, it is confirmed that radio waves are radiated only, in the main slot 110 and are not radiated in the sub slot 120.

A current in the antenna apparatus 100 in which the main slot 110, the sub slot 120, and the slot coupler 130 are formed is as illustrated in FIG. 6. As shown in FIG. 6, it is confirmed that the current distribution in the antenna is concentrated around the main slot 110, but the current distribution spreads to the sub slot 120 along the slot coupler 130, Accordingly, it is confirmed that radio waves are radiated in not only the main slot 110 but also the sub slot 120.

As described above, the slot coupler 130 may couple the main slot 110 to the sub slot 120 and may induce radio waves to be radiated in not only the main slot 110 but also the sub slot 120.

As such, because radio waves are radiated in not only the main slot 110 but also the sub slot 120, the radiation pattern of the antenna apparatus 100 is different from that of a general slot antenna.

As described above, the radiation pattern of the slot antenna is substantially similar to that of the dipole antenna. A general slot antenna may propagate radio waves in a direction perpendicular to the slot (front and rear when the long axis direction of the slot is defined as upper/lower side) and the short axis direction of the slot (left and right when the long axis direction of the slot is defined as top/bottom side). In particular, the slot antenna shows a radiation pattern in which a center line thereof is perpendicular to the slot.

Compared to the above, the radiation pattern in the antenna apparatus 100 may radiate radio waves in an inclined direction because radio waves are radiated in not only the main slot 110 but also the sub slot 120.

A radiation pattern in the antenna apparatus 100 in a forward and rearward direction (in a direction perpendicular to the slot) is as illustrated in FIG. 7, As shown in FIG. 7, the antenna apparatus 100 has a radiation pattern directing forward and upward. In other words, the antenna apparatus 100 has a radiation pattern biased in a direction opposite to the direction in which the sub slot 120 is provided about the main slot 110. Also, the antenna apparatus 100 has a radiation pattern directing rearward and downward. In other words, the antenna apparatus 100 has a radiation pattern around the main slot 110 and biased in the direction in which the sub slot 120 is provided.

As such, the upward or downward biased radiation pattern has an advantageous effect when the antenna apparatus 100 is installed on the front window 17 or the rear window 19. In general, a preceding vehicle or a following vehicle runs on the same plane (road) as the vehicle 1, and it is advantageous that the antenna apparatus has a radiation pattern in a direction parallel to the road in order to communicate with the preceding vehicle or the following vehicle.

The surfaces of the front window 17 and the rear window 19 are generally, disposed to be inclined with respect to a road or a plane perpendicular to the road. When a general slot antenna is disposed on the inclined front window 17 and rear window 19, the radiation pattern of the antenna may not be parallel to the road. For example, when the front window 17 and the rear window 19 are disposed at an inclined angle of 45 degrees with respect to the road, the radiation pattern of the slot antenna is expected to direct upward by 45 degrees.

On the other hand, the antenna apparatus 100 has a radiation pattern inclined forward upward or forward downward. Accordingly, when the antenna apparatus 100 is installed on the inclined front window 17 and rear window 19, the antenna apparatus 100 may have a radiation pattern that is substantially parallel to a road. For example, when the antenna apparatus 100 having a radiation pattern of directing forward and downward at an angle of 45 degrees is installed on the front window 17 disposed to be inclined at an angle of 45 degrees, the antenna apparatus 100 may emit radio waves in a direction substantially parallel to a road.

Figure 8:
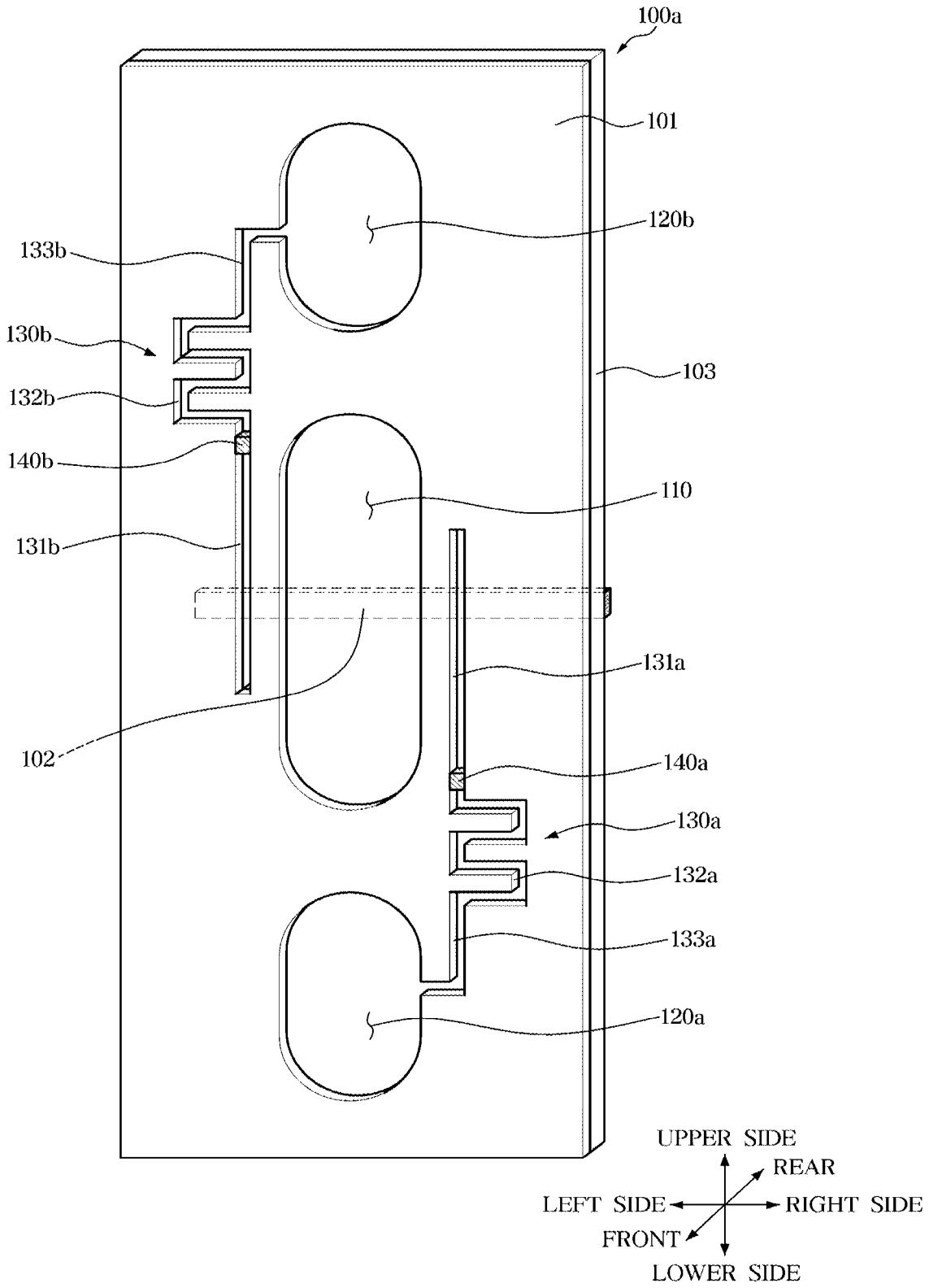
FIG. 8 illustrates an antenna apparatus according to an embodiment.
Figure 9A:
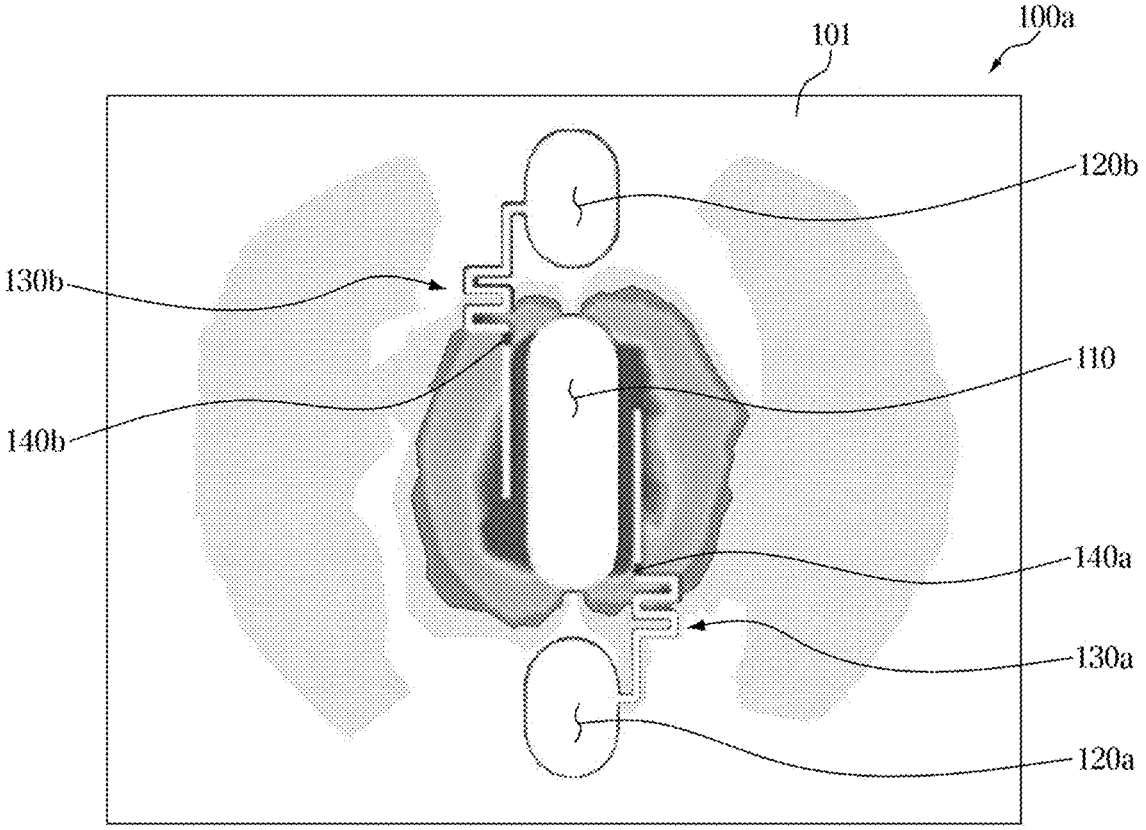
FIGS. 9A and 9B illustrate a current distribution and a radiation pattern in a first state of the antenna apparatus according to an embodiment.
Figure 9B:
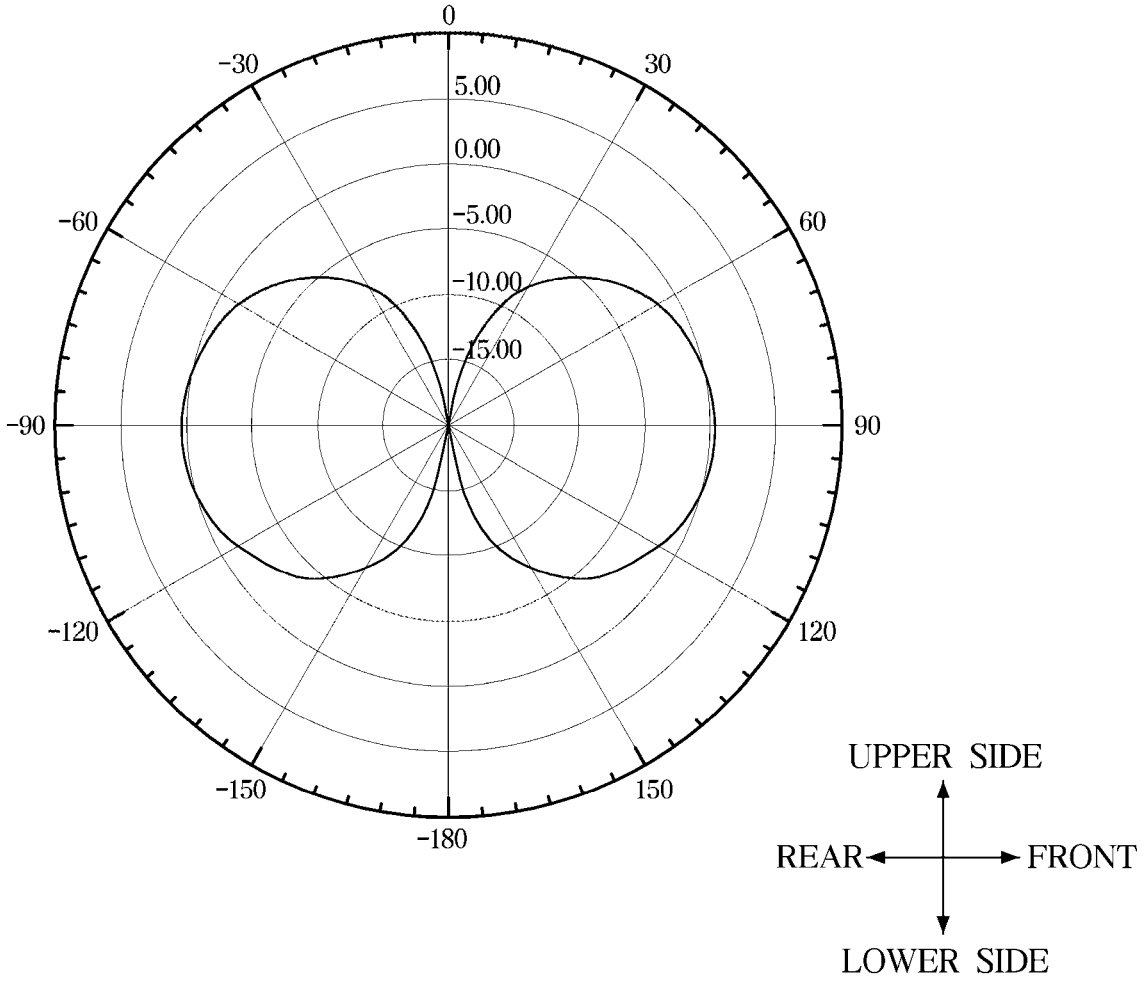
Figure 10A:
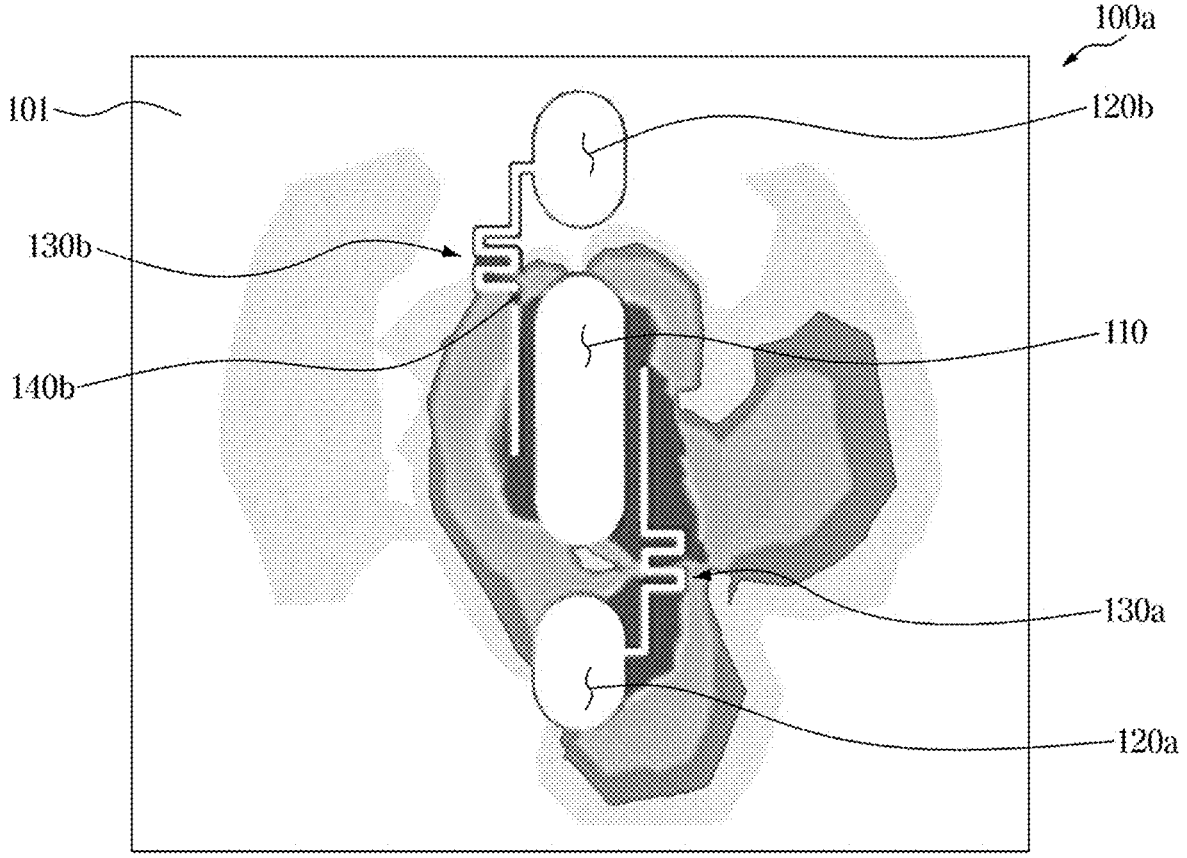
FIGS. 10A and 10B illustrate a current distribution and a radiation pattern in a second state of the antenna apparatus according to an embodiment.
Figure 10B:
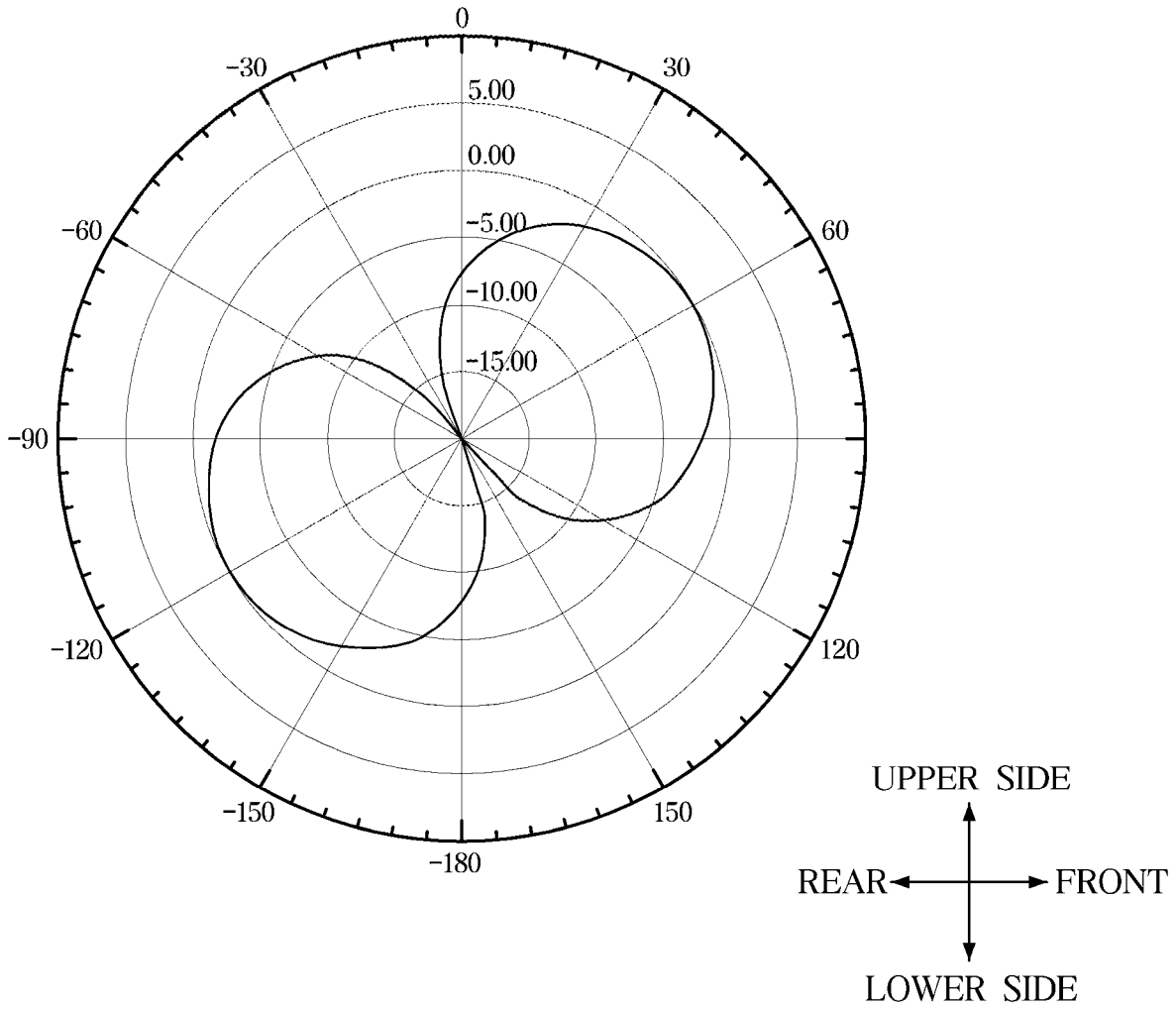
Figure 11A:
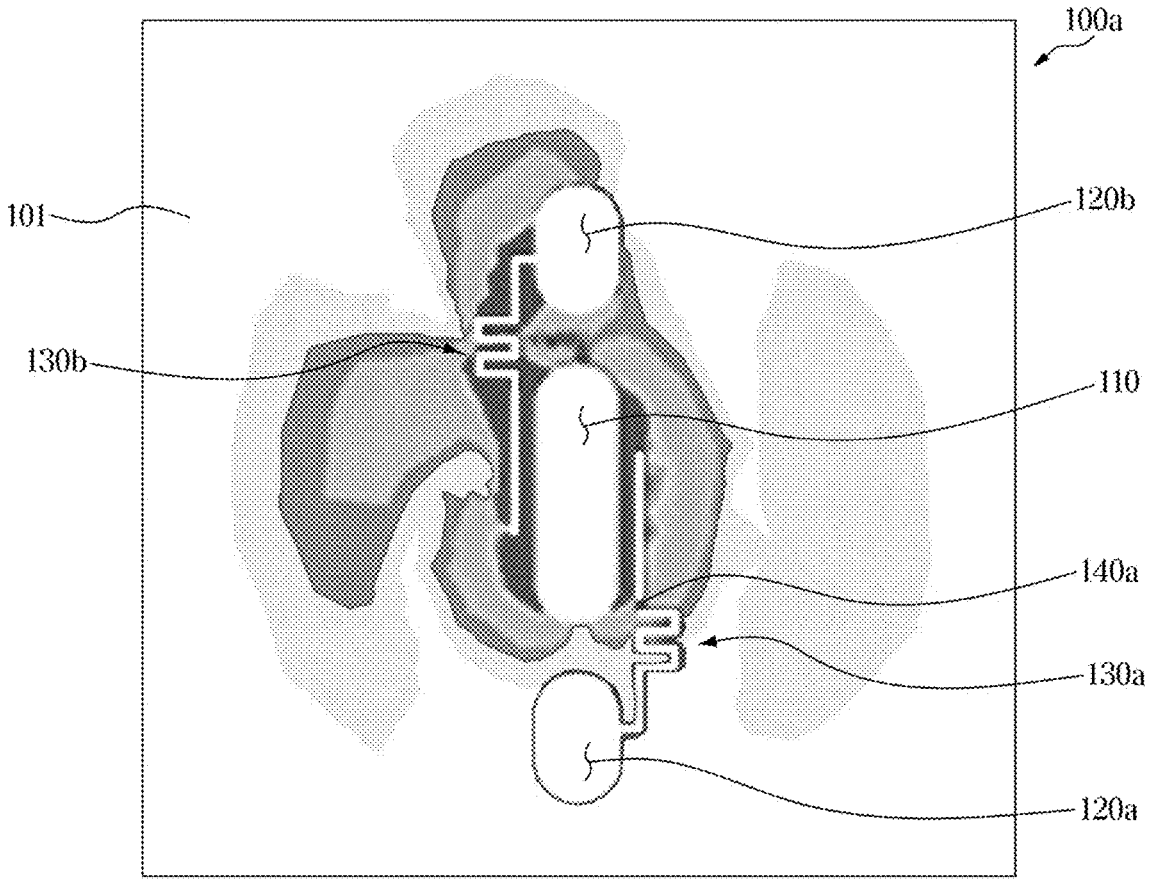
FIGS. 11A and 11B illustrate a current distribution and a radiation pattern in a third state of the antenna apparatus according to an embodiment.
Figure 11B:
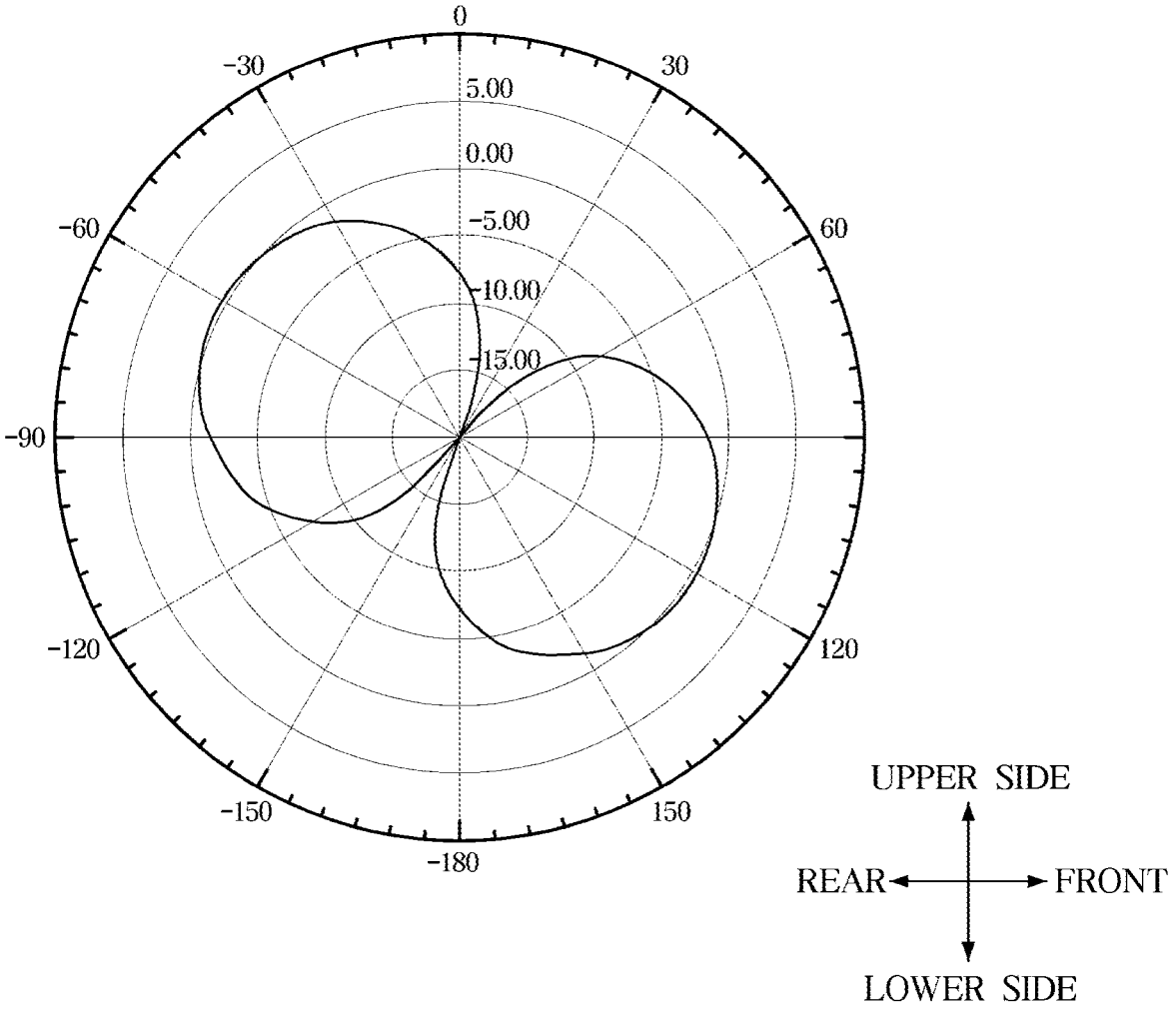
Figure 12A:
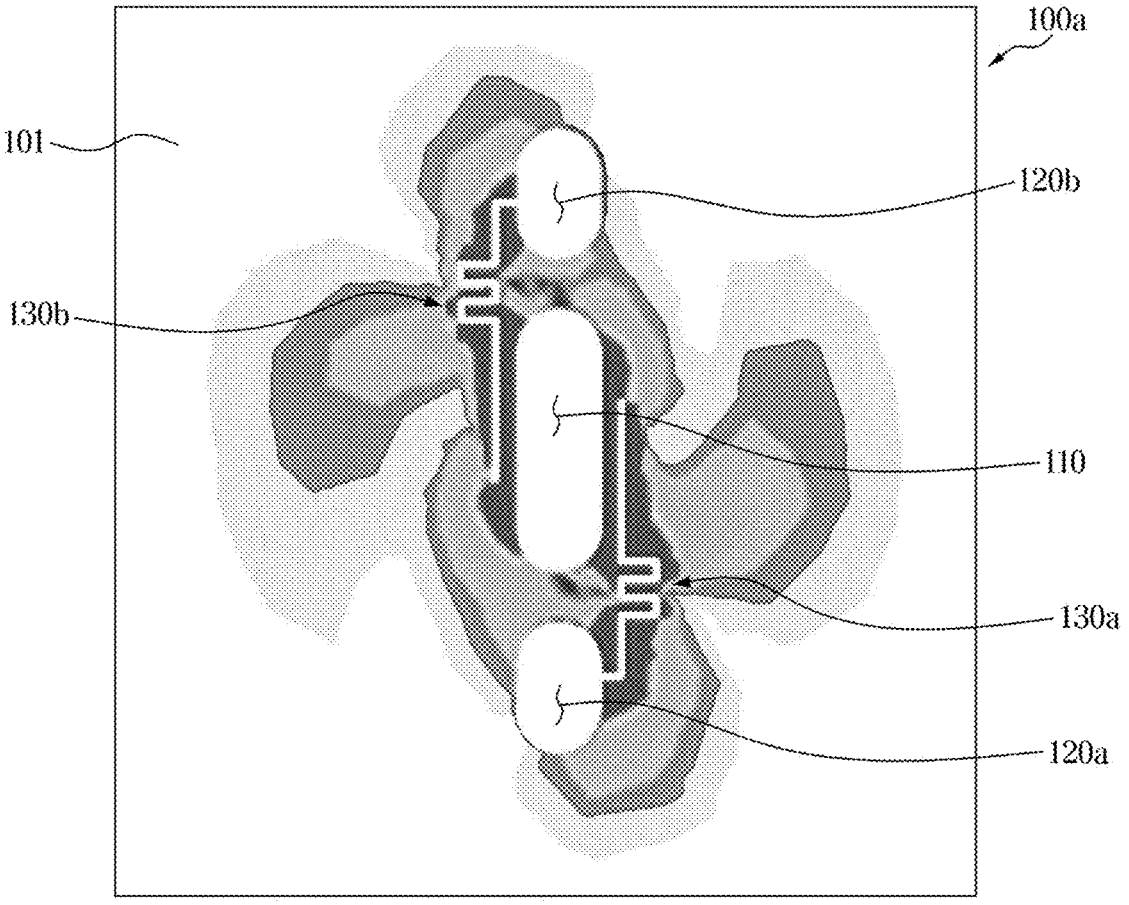
FIGS. 12A and 12B illustrate a current distribution and a radiation pattern in a fourth state of the antenna apparatus according to an embodiment.
Figure 12B:
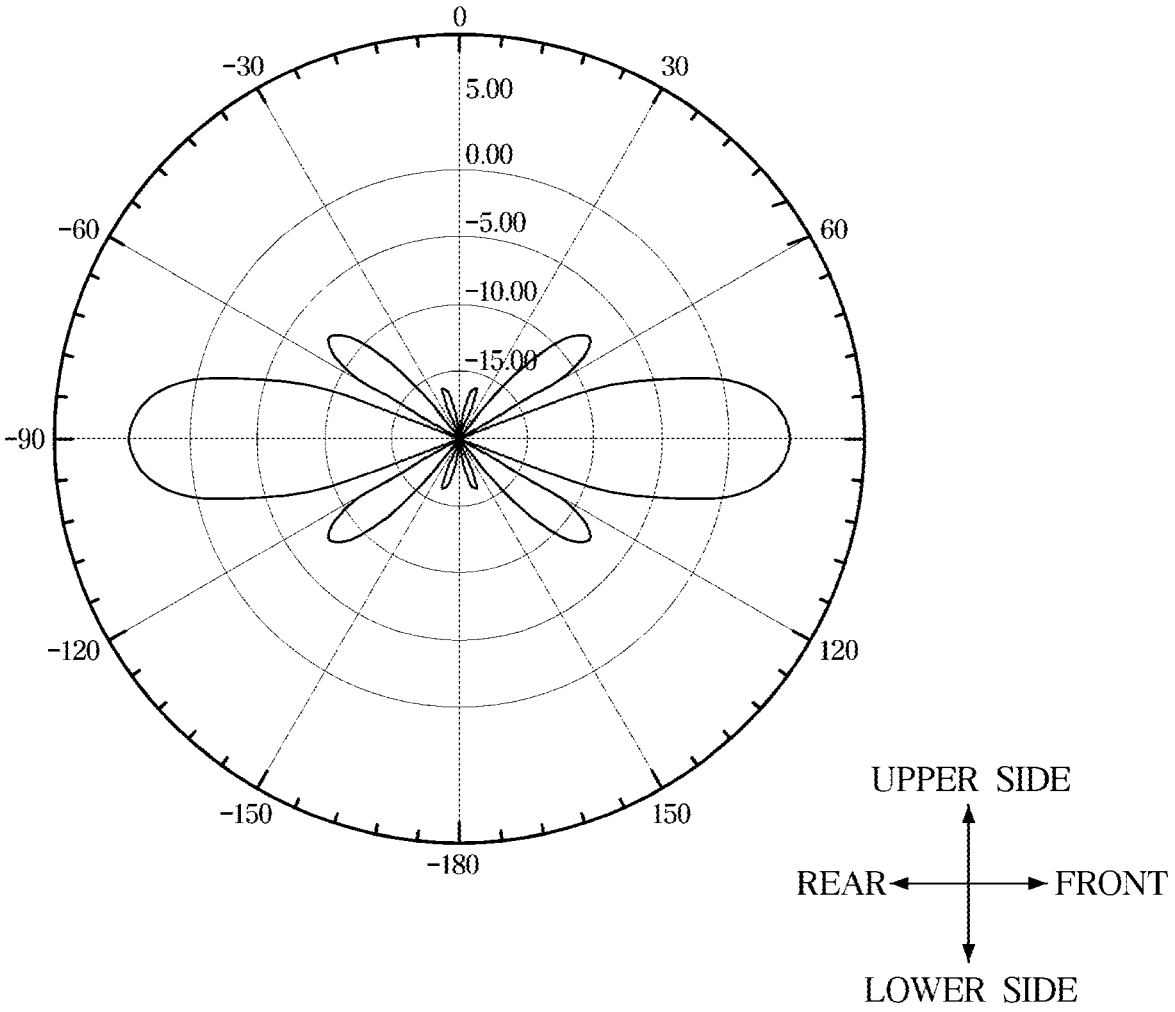

FIG. 8 illustrates an antenna apparatus according to an embodiment, FIGS. 9A-9B illustrate a current distribution and a radiation pattern in a first state of the antenna apparatus according to an embodiment, FIGS. 10A-10B illustrate a current distribution and a radiation pattern in a second state of the antenna apparatus according to an embodiment, FIGS. 11A and 11B illustrate a current distribution and a radiation pattern in a third state of the antenna apparatus according to an embodiment, and FIGS. 12A and 12B illustrate a current distribution and a radiation pattern in a fourth state of the antenna apparatus according to an embodiment.

As illustrated in FIG. 8, an antenna apparatus 100*a* includes the conductive plate 101 on which the main slot 110, a first sub slot 120*a*, a second sub slot 120*b*, a first slot coupler 130*a*, a second slot coupler 130*b*, a first coupler switch 140*a*, and a second coupler switch 140*b* are formed.

The conductive plate 101 may be made of the same material as the conductive plate illustrated in FIGS. 3A and 3B, and the main slot 110, the first sub slot 120*a*, the second sub slot 120*b*, the first slot coupler 130*a*, and the second slot coupler 130*b* are formed to penetrate the conductive plate 101.

The main slot 110 has a slim and long shape, and has the same shape as the main slot 110 illustrated in FIGS. 3A and 3B, and may provide the same function.

The first sub slot 120*a* is formed in the vicinity of the main slot 110 (below the main slot in the drawing), and has the same shape as the sub slot 120 illustrated in FIGS. 3A and 3B, and may provide the same function.

The first slot coupler 130*a* is provided in the vicinity of the main slot 110 and the first sub slot 120*a* (the right of the main slot and the first sub slot in the drawing), and has the same shape as the slot coupler 130 illustrated in FIG. 3A, and may provide the same function. The first slot coupler 130*a* includes a first coupling induction portion 131*a*, a first phase delay portion 132*a*, and a first slot connection portion 133*a*.

The second sub slot 120*b* may be provided in the vicinity of the main slot 110 on the opposite side of the first sub slot 120*a*. (above the main slot in the drawing). The second sub slot 120*b* has the same shape as the sub slot 120 illustrated in FIGSA and 3B, and may provide the same function.

The second slot coupler 130*b* is provided in the vicinity of the main slot 110 and the second sub slot 120*b* (the left of the main slot and the second sub slot in the drawing), and has the same shape as the slot coupler 130 illustrated in FIG. 3A, and may provide the same function. The second slot coupler 130*b* includes a second coupling induction portion 131*b*, a second phase delay portion 132*b*, and a second slot connection portion 133*b*.

The first coupler switch 140*a* may allow or block coupling between the main slot 110 and the first sub slot 120*a* by the first slot coupler 130*a*.

As illustrated in FIG. 8, the first coupler switch 140*a* may be disposed between the first coupling induction portion 131*a* and the first phase delay portion 132*a*. The first coupler switch 140*a* may allow or block a connection between the first coupling induction portion 131*a*, and the first phase delay portion 132*a*. The first coupler switch 140*a* is disposed across the first slot coupler 130*a*, between the first coupling induction portion 131*a* and the first phase delay portion 132*a*.

In order to block a connection between the first coupling induction portion 131*a* and the first phase delay portion 132*a* in response to a control signal of the wireless communication device 50, the first coupler switch 140*a* may electrically connect right and left sides of the first slot coupler 130*a* on the inductive plate 101. In other words, the first coupler switch 140*a* may be turned on or closed. When the right and the left sides of the first slot coupler 130*a* on the inductive plate 101 is electrically connected, propagation of the electromagnetic field along the first slot coupler 130*a* may be blocked. As such, when the first coupler switch 140*a* is turned on or closed, the coupling between the main slot 110 and the first sub slot 120*a* is blocked, and the main slot 110 may operate independently.

Also, in order to allow a connection between the first coupling induction portion 131*a* and the first phase delay portion 132*a* in response to a control signal of the wireless communication device 50, the first coupler switch 140*a* may block an electrical connection between the right and the left sides of the first slot coupler 130*a* on the inductive plate 101. In other words, the first coupler switch 140*a* may be turned off or opened. When the electrical connection between the right and the left sides of the first slot coupler 130*a* on the inductive plate 101 is blocked, propagation of the electromagnetic field along the first slot coupler 130*a* may be allowed. As such, when the first coupler switch 140*a* is turned off or opened, the coupling between the main slot 110 and the first sub slot 120*a* is allowed, and the main slot 110 and the first sub slot 120*a* may operate together.

The second coupler switch 140*b* may allow or block coupling between the main slot 110 and the second sub slot 120*b* by the second slot coupler 130*b*.

A specific configuration and operation of the second coupler switch 140*b* may be the same as those of the first coupler switch 140*a*.

The antenna apparatus 100*a* may further include the feed line 102 and the dielectric 103. The feed line 102 and the dielectric 103 may be the same as the feed line 102 and the dielectric 103 illustrated in FIG. 3A.

Hereinafter, a current distribution and a radiation pattern of the antenna apparatus 100*a* according to the opening and closing of the first coupler switch 140*a* and the second coupler switch 140*b* will be described.

When both the first coupler switch 140*a* and the second coupler switch 140*b* are turned on (or closed) in a first state, the coupling between the main slot 110 and the first sub slot 120*a* is blocked, and the coupling between the main slot 110 and the second sub slot 120*b* is blocked.

When an electrical signal is provided to the antenna apparatus 100*a* through the teed line 102 in a state in which the couplings between the main slot 110 and the first and second sub slots 120*a* and 120*b* are blocked, a current is induced around the main slot 110 as illustrated in FIG. 9A. Because the couplings between the main slot 110 and the first and second sub slots 120*a* and 120*b* are blocked, the current around the main slot 110 may not be propagated to the first and second sub slots 120*a* and 120*b*.

Therefore, radio waves are radiated only in the main slot 110, and the antenna apparatus 100*a* may have a radiation pattern in which radio waves are radiated to the front and rear (direction perpendicular to the main slot) of the antenna apparatus 100*a* as illustrated in FIG. 9B.

When the first coupler switch 140*a* is turned off (or open) and the second coupler switch 140*b* is turned on (or closed) in a second state, the coupling between the main slot 110 and the first sub slot 120*a* is allowed, and the coupling between the main slot 110 and the second sub slot 120*b* is blocked.

When an electrical signal is provided to the antenna apparatus 100*a* through the feed line 102 in the second state, a current is induced around the main slot 110 as illustrated in FIG. 10A. Because the coupling between the main slot 110 and the first sub slot 120*a* is allowed, the current may also be induced around the first sub slot 120*a*. On the other hand, because the coupling between the main slot 110 and the second sub slot 120*b* is blocked, the current is not induced around the second sub slot 120*b*.

Therefore, radio waves are radiated in the main slot 110 and the first sub slot 120*a*, and the antenna apparatus 100*a* may have a radiation pattern in which radio waves are radiated forward upward and rearward downward as illustrated in FIG. 10B.

When the first coupler switch 140*a* is turned on (or closed) and the second coupler switch 140*b* is turned off (or open) in a third state, the coupling between the main slot 110 and the first sub slot 120*a* is blocked, and the coupling between the main slot 110 and the second sub slot 120*b* is allowed.

When an electrical signal is provided to the antenna apparatus 100*a* through the feed line 102 in the third state, a current is induced around the main slot 110 as illustrated in FIG. 11A. Because the coupling between the main slot 110 and the second sub slot 120*b* is allowed, the current may also be induced around the second sub slot 120*b*. On the other hand, because the coupling between the main slot 110 and the first sub slot 120*a* is blocked, the current is not induced around the first sub slot 120*a*.

Therefore, radio waves are radiated in the main slot 110 and the second sub slot 120*b*, and the antenna apparatus 100*a* may have a radiation pattern in which radio waves are radiated forward downward and rearward upward as illustrated in FIG. 11B.

When both the first coupler switch 140*a* and the second coupler switch 140*b* are turned off (or open) in a fourth state, the coupling between the main slot 110 and the first sub slot 120*a* is allowed, and the coupling between the main slot 110 and the second sub slot 120*b* is allowed.

When an electrical signal is provided to the antenna apparatus 100*a* through the feed line 102 in a state in which the couplings between the main slot 110 and the first and second sub slots 120*a* and 120*b* are allowed, a current is induced around the main slot 110 as illustrated in FIG. 12A. Because the couplings between the main slot 110 and the first and second sub slots 120*a* and 120*b* are allowed, the current around the main slot 110 may be propagated to the first and second sub slots 120*a* and 120*b*.

Therefore, radio waves are radiated in all of the main slot 110, the first sub slot 120*a*, and the second sub slot 120*b*, and the antenna apparatus 100*a* may have a radiation pattern in which radio waves are radiated to the front and rear (direction perpendicular to the main slot) of the antenna apparatus 100*a* as illustrated in FIG. 213. However, compared to the radiation pattern of the antenna apparatus 100*a* in the first state, the radiation pattern of the antenna apparatus 100*a* in the fourth state has a narrower width and a longer length. In other words, in the fourth state, the antenna apparatus 100*a* may radiate radio waves farther in a narrow range.

As is apparent from the above, according to an aspect of the disclosure, an antenna apparatus disposed on a front window and/or a rear window can be provided.

Further, according to an aspect of the disclosure, an antenna apparatus capable of beam-forming from an inclined front window and/or an inclined rear window toward the front and/or rear of a vehicle can be provided. Accordingly, the antenna apparatus can smoothly communicate with a preceding vehicle and/or a following vehicle.

While the disclosure has been particularly described with reference to exemplary embodiments, it should be understood by those of skilled in the art that various changes in form and details may be made without departing from the spirit and scope of the disclosure.

The invention claimed is:

1. An antenna apparatus comprising:

a conductive plate on which a main slot, a sub slot, and a slot coupler are formed;

a feed line; and a dielectric positioned between the conductive plate and the feed line, wherein the main slot, the sub slot, and the slot coupler penetrate the conductive plate; and wherein the slot coupler extends from the sub slot to a position adjacent to the main slot; and wherein the main slot is formed such that a width in a long axis direction is longer than a width in a short axis direction, and the sub slot is spaced apart from the main slot in the long axis direction of the main slot.

2. The antenna apparatus according to claim 1, wherein the slot coupler comprises a coupling induction portion extending parallel to the main slot in the vicinity of the main slot, a slot connection portion connected to the sub slot, and a phase delay portion disposed between the coupling induction portion and the slot connection portion.

3. The antenna apparatus according to claim 2, wherein the phase delay portion is formed in an S-shape and extends from the coupling induction portion to the slot connection portion.

4. The antenna apparatus according to claim 1, wherein the slot coupler is configured to couple the sub slot to the main slot.

5. The antenna apparatus according to claim 2, further comprising a coupler switch disposed across the slot coupler to allow or block coupling between the sub slot and the main slot.

6. The antenna apparatus according to claim 5, wherein a radiation pattern of the antenna apparatus is changed depending on turn-on or turn-off of the coupler switch.

7. An antenna apparatus comprising:

a conductive plate on which a main slot, a first sub slot, a second sub slot, a first slot coupler, and a second slot coupler are formed;

a feed line; and a dielectric positioned between the conductive plate and the feed line;

wherein the main slot, the first sub slot, the second sub slot, the first slot coupler, and the second slot coupler penetrate the conductive plate;

wherein the first slot coupler extends from the first sub slot to the main slot;

wherein the second slot coupler extends from the second sub slot to a position adjacent to the main slot; and wherein the main slot is formed such that a width in a long axis direction is longer than a width in a short axis direction, the first sub slot is spaced apart from the main slot in the long axis direction of the main slot, and the second sub slot is spaced apart from the main slot on the opposite side of the first sub slot in the long axis direction of the main slot.

8. The antenna apparatus according to claim 7, wherein the first and second slot couplers comprise:

first and second coupling induction portions extending parallel to the main slot;

first and second slot connection portions connected to the first and second sub slots; and first and second phase delay portions disposed between the first and second coupling induction portions and the first and second slot connection portions, respectively.

9. The antenna apparatus according to claim 8, wherein the first and second phase delay portions are formed in an S-shape and extend from the first and second coupling induction portions to the first and second slot connection portions, respectively.

10. The antenna apparatus according to claim 7, wherein the first and second slot couplers are configured to couple the first and second sub slots to the main slot, respectively.

11. The antenna apparatus according to claim 10, further comprising:

a first coupler switch disposed across the first slot coupler to allow or block coupling between the first sub slot and the main slot; and a second coupler switch disposed across the second slot coupler to allow or block coupling between the second sub slot and the main slot.

12. The antenna apparatus according to claim 11, wherein a radiation pattern of the antenna apparatus is changed depending on turn-on or turn-off of each of the first and second coupler switches.

13. A vehicle comprising:

a front window;

a wireless communication device; and an antenna apparatus positioned on the front window configured to electrically connect to the wireless communication device;

wherein the antenna apparatus comprises:

a conductive plate on which a main slot, a sub slot, and a slot coupler are formed;

a feed line; and a dielectric positioned between the conductive plate and the feed line;

wherein the main slot, the sub slot, and the slot coupler penetrate the conductive plate;

wherein the slot coupler extends from the sub slot to a position adjacent to the main slot to couple the sub slot to the main slot;

wherein the antenna apparatus further comprises a coupler switch disposed across the slot coupler to allow or block coupling between the sub slot and the main slot in response to a control signal of the wireless communication device; and wherein the main slot is formed such that a width in a long axis direction is longer than a width in a short axis direction, and the sub slot is disposed to be spaced apart from the main slot in the long axis direction of the main slot.

14. The vehicle according to claim 13, wherein a radiation pattern of the antenna apparatus is changed depending on turn-on or turn-off of the coupler switch.

15. The vehicle according to claim 13, wherein the slot coupler comprises a coupling induction portion extending parallel to the main slot in the vicinity of the main slot, a slot connection portion connected to the sub slot, and a phase delay portion disposed between the coupling induction portion and the slot connection portion.

16. The vehicle according to claim 15, wherein the phase delay portion is formed in an S-shape and extends from the coupling induction portion to the slot connection portion.

* * * * *